US009410377B2

(12) United States Patent
Jain et al.

(10) Patent No.: US 9,410,377 B2
(45) Date of Patent: Aug. 9, 2016

(54) APPARATUS AND METHODS FOR DETERMINING WHIRL OF A ROTATING TOOL

(75) Inventors: Jayesh R. Jain, The Woodlands, TX (US); Olivier J.-M. Hoffmann, The Woodlands, TX (US); Leroy W. Ledgerwood, III, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 751 days.

(21) Appl. No.: 13/422,860

(22) Filed: Mar. 16, 2012

(65) Prior Publication Data

US 2013/0245950 A1 Sep. 19, 2013

(51) Int. Cl.
*E21B 10/00* (2006.01)
*E21B 47/00* (2012.01)

(52) U.S. Cl.
CPC ..... *E21B 10/00* (2013.01); *E21B 47/00* (2013.01)

(58) Field of Classification Search
CPC ..... E21B 44/00; E21B 10/62; E21B 10/5673; E21B 10/55; E21B 47/00; E21B 10/00; E21B 10/003; E21B 43/126
USPC ..... 702/9, 54, 141, 152.44, 152, 58; 175/24
See application file for complete search history.

(56) References Cited

U.S. PATENT DOCUMENTS 4,903,245 A 2/1990 Close et al.
4,928,521 A 5/1990 Jardine
5,469,736 A 11/1995 Moake
5,864,058 A * 1/1999 Chen ..... 73/152.47
6,142,228 A * 11/2000 Jogi et al. ..... 166/250.01
6,205,851 B1 * 3/2001 Jogi ..... 73/152.47
6,467,341 B1 10/2002 Boucher et al.
7,604,072 B2 10/2009 Pastusek et al.
2004/0196177 A1 * 10/2004 Billington et al. ..... 342/174
2004/0251898 A1 * 12/2004 Morys et al. ..... 324/303
2009/0266160 A1 * 10/2009 Jeffrey et al. ..... 73/455
2011/0024192 A1 2/2011 Pastusek et al.

OTHER PUBLICATIONS

PCT International Preliminary Report on Patentability; International Application No. PCT/US2013/032415; International Filing Date: Mar. 15, 2013; Date of Mailing: Sep. 25, 2014; pp. 1-10.
Pastusek, Paul et al.; "Development and Utilization of a Bit-Based Data-Acquisition System in Hard-Rock PDC Applications," SPE/IADC 105017, 2007 SPE/IADC Drilling Conference, Amsterdam, The Netherlands, Feb. 20-22, 2007, pp. 1-10.
Shyu, Rong-Juin; "Bending Vibration of Rotating Drill Strings," Massachusetts Institute of Technology, Chapter 2, Measurement Systems on a Rotating Shaft, 1989, pp. 18-32.
Shyu, Rong-Juin; "Identification of Whirling Motions by Phase Unwrapping Technique," Journal of Marine Science and Technology, vol. 1, No. 1, 1993, pp. 13-17.
Vandiver, J. Kim et al.; "Case Studies of the Bending Vibration and Whirling Motion of Drill Collars," SPE Drilling Engineering, Dec. 1990, pp. 282-290.

* cited by examiner

*Primary Examiner* — Mohamed Charioui
*Assistant Examiner* — Catherine Rastovski
(74) *Attorney, Agent, or Firm* — Cantor Colburn LLP

(57) ABSTRACT

In one aspect, a method of determining the presence of whirl for a rotating tool is disclosed that in one embodiment includes obtaining measurements ($a_x$) of a parameter relating to the whirl of the tool along a first axis and measurements ($a_y$) of the parameter along a second axis of the tool, determining a first whirl in a time domain for the tool using $a_x$ and $a_y$ measurements, determining a second whirl rate for the tool in a frequency domain from $a_x$ and $a_y$ measurements and determining the presence of the whirl from the first whirl rate and second whirl rate. The method further quantifies the whirl of the tool from the first and second whirl rates.

21 Claims, 5 Drawing Sheets

APPARATUS AND METHODS FOR DETERMINING WHIRL OF A ROTATING TOOL

BACKGROUND

1. Field of the Disclosure

This disclosure relates generally to determining whirl rate of rotating members, such as drilling assemblies.

2. Background of the Art

Drill strings containing a drilling assembly (also referred to as the "bottomhole assembly") having a drill bit an end thereof are used to drill wellbores for the production of hydrocarbons from earth formations. The drill bit is rotated with weight-on-bit applied from the surface. A fluid is circulated through the drill string, drill bit and the annulus between the drill string and the wellbore to lubricate the drill bit and to carry the rock cuttings made by the drill bit to the surface. The drilling assembly and the drill bit can exhibit a variety of motions in addition to the rotation of the drill bit along a linear path. Such motions are generally referred to as dysfunctions and include vibration, displacement of the tool along a direction other than the drilling direction, bending moments and whirl. Whirl occurs in rotating members such as drill strings, drill bits, shafts, etc. Whirl (also referred to as "whirl rate," "whirl frequency" and "whirl velocity") of a rotating member, such as shaft, may be defined as "the rotation of the plane made by a bent shaft and the line of the centers of the bearings." In this definition, whirl can be forward whirl (rotation in the same direction as the shaft rotation direction) or backward whirl (rotation in the opposite direction to the shaft rotation direction). When the shaft whirls at the same speed as it rotates about its axis, the whirl is said to be synchronous. In terms of drilling systems, the most violent and most frequently observed type of whirl is the backward whirl. Often whirl induces failures in the BHA components and damages the drill bit.

The disclosure herein provides apparatus and methods for determining the whirl rate for a rotating member, such as a drilling assembly and drill bit.

SUMMARY

In one aspect, a method of determining when whirl for a rotating tool is present is disclosed. The method in one embodiment includes: obtaining measurements ($a_x$) of a parameter relating to the whirl of the tool along a first axis of the tool and measurements ($a_y$) relating to the parameter along a second axis of the tool; determining a first whirl rate in a time domain for the tool using $a_x$ and $a_y$ measurement, determining a second whirl rate for the tool in a frequency domain from $a_x$ and $a_y$ confirming when the whirl is present from the first whirl rate and the second whirl rate. In aspects, the whirl is present when the first whirl rate and the second whirl rate meet a selected criterion. In another aspect, the method may further determine the direction and magnitude of the whirl from the first whirl rate and the second whirl rate.

In another aspect, an apparatus for determining when whirl is present in a rotating tool is disclosed. The apparatus in one embodiment includes sensors configured to provide measurements ($a_x$) of a parameter relating to the whirl of the tool along a first axis of the tool and measurements ($a_y$) of the parameter relating to the whirl of the tool along a second axis of the tool and a processor configured to: determine a first whirl rate for the tool in a time domain from the $a_x$ and $a_y$ measurements; determine a second whirl rate for the tool in a frequency domain from the $a_x$ and $a_y$ measurements and determining when the whirl for the tool is present from the first whirl rate and second whirl rate. In another aspect, the processor may be further configured to determine the direction and magnitude of the whirl from the first and second whirl rates.

Examples of certain features of the apparatus and methods disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
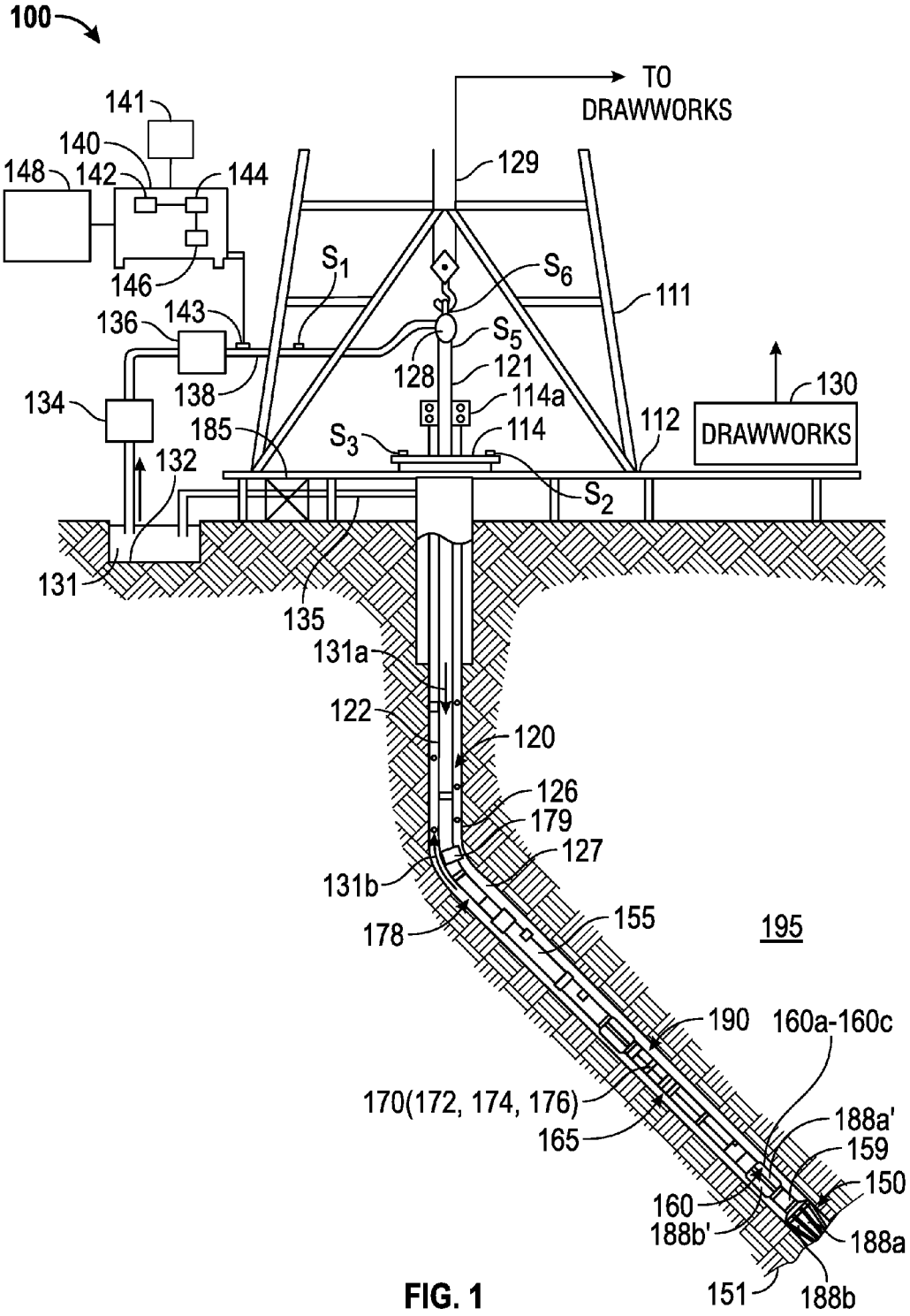
FIG. 1 is an elevation view of a drilling system that includes devices for determining whirl of the drill string and/or the drill bit during drilling of a wellbore.

FIG. 1 is a schematic diagram of an exemplary drilling system 100 that includes a drill string 120 having a drilling assembly or a bottomhole assembly 190 attached to its bottom end. Drill string 120 is shown conveyed in a borehole 126 formed in a formation 195. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to the drilling assembly 190, disintegrates the geological formation 195. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

To drill the wellbore 126, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* discharges at the borehole bottom 151 through openings in the drill bit 150.

The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation. A surface control unit or controller 140 receives: signals from the downhole sensors and devices via a sensor 143 placed in the fluid line 138; and signals from sensors $S_1$-$S_6$ and other sensors used in the system 100 and processes such signals according to programmed instructions provided to the surface control unit 140. The surface control unit 140 displays desired drilling parameters and other information on a display/monitor 141 for the operator. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations drilling operations.

The drilling assembly 190 may also contain formation evaluation sensors or devices (also referred to as measurement-while-drilling (MWD) or logging-while-drilling (LWD) sensors) for providing various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (including, but not limited to, velocity, vibration, bending moment, acceleration, oscillation, whirl, and stick-slip) and drilling operating parameters, including, but not limited to, weight-on-bit, fluid flow rate, and rotational speed of the drilling assembly.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. A control unit 170 processes data from downhole sensors and controls operation of various downhole devices. The control unit includes a processor 172, such as microprocessor, a data storage device 174, such as a solid-state memory and programs 176 stored in the data storage device 174 and accessible to the processor 172. A suitable telemetry unit 179 provides two-way signal and data communication between the control units 140 and 170.

During drilling of the wellbore 126, forward and/or backward whirl of the drill bit is sometimes encountered. Excessive whirl can damage the drill bit, sensors and other components in the drilling assembly 190. The system 100 described herein includes at least two sensors that provide measurements relating to the whirl in two substantially orthogonal directions to the longitudinal axis of the drilling assembly 190. In one embodiment, sensors 188*a* and 188*b* are placed in the drill bit 150. In another embodiment sensors 188*a*' and 188*b*' are placed in the drilling assembly 190 and or at another suitable location in the drill string 120. The suitable sensors include sensors that provide measurements for acceleration, bending moment, velocity and/or displacement. For ease of explanation, the methods of determining whirl according to this disclosure herein are described in reference to exemplary FIGS. 2-5 using acceleration measurements obtained from sensors 188*a*, 188*b* or 188*a*' and 188*b*'.

Figure 2:
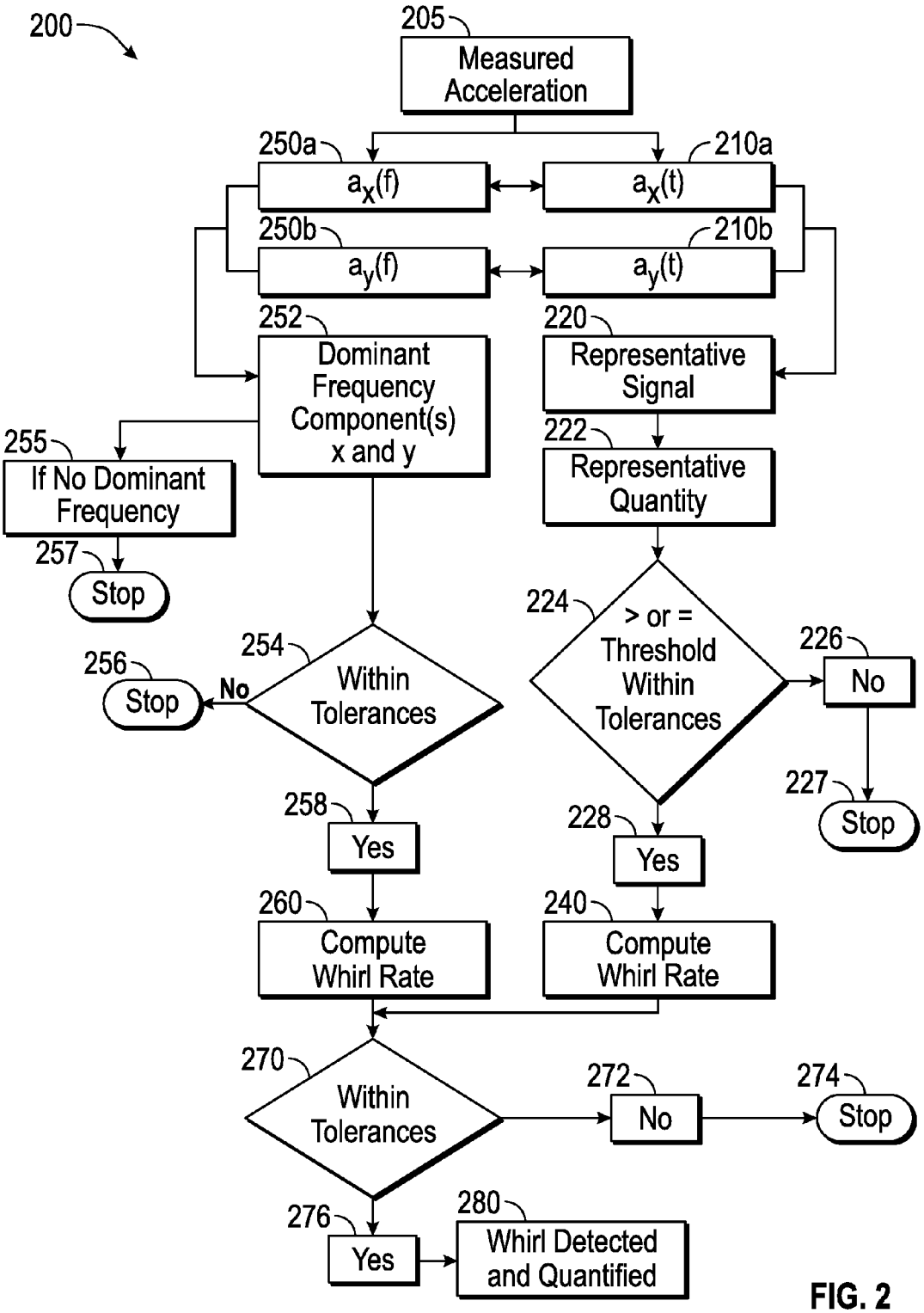
FIG. 2 is a flow diagram showing a method for determining whirl, according to one embodiment of the disclosure.

FIG. 2 is a flow diagram showing a method 200 for determining the presence and magnitude (rate) of whirl, according to one embodiment of the disclosure. The exemplary method 200 is described utilizing acceleration measurement made in two orthogonal directions $a_x(t)$ and $a_y(t)$ to the tool longitudinal axis obtained from the sensors in the tool or derived from prior measurement data (205). In one aspect, the measurement signals may include original measurements (also referred to as the raw data) or partially processed raw data (for example, filtered version of original measurements). In one aspect, these measurements may be taken over selected time windows, such as five seconds or another suitable duration. In aspects, the time history of the measured parameter may be sub-divided into multiple signals of smaller duration for more accurate identification of whirl in cases where whirl may exist for a smaller duration than the duration of the measurement window.

In this particular example, the acceleration measurements $a_x(t)$ and $a_y(t)$ are radial and tangential accelerations and are respectively identified at boxes 210*a* and 210*b*. A value or quantity 222 of a parameter 220, such as lateral acceleration, is calculated from $a_x(t)$ and $a_y(t)$. It is known that high lateral acceleration may be an indication of whirl. If the value 222 of the lateral acceleration 220 is below a threshold level or within a selected tolerance, such as identified at the decision box 224 and box 226, the process for determining whirl may be stopped (Box 227), signifying absence of whirl. If the value 222 of the lateral acceleration 220 exceeds the threshold or is outside the tolerance level (Box 228), signifying that whirl may be present. In such a case, the whirl in time domain is calculated. In one aspect, the whirl rate may be computed using a phase unwrapping method using the relationship:

$$\text{whirl rate} = \text{rotational speed of the tool} - \text{slope of the phase angle}$$

Figure 5:
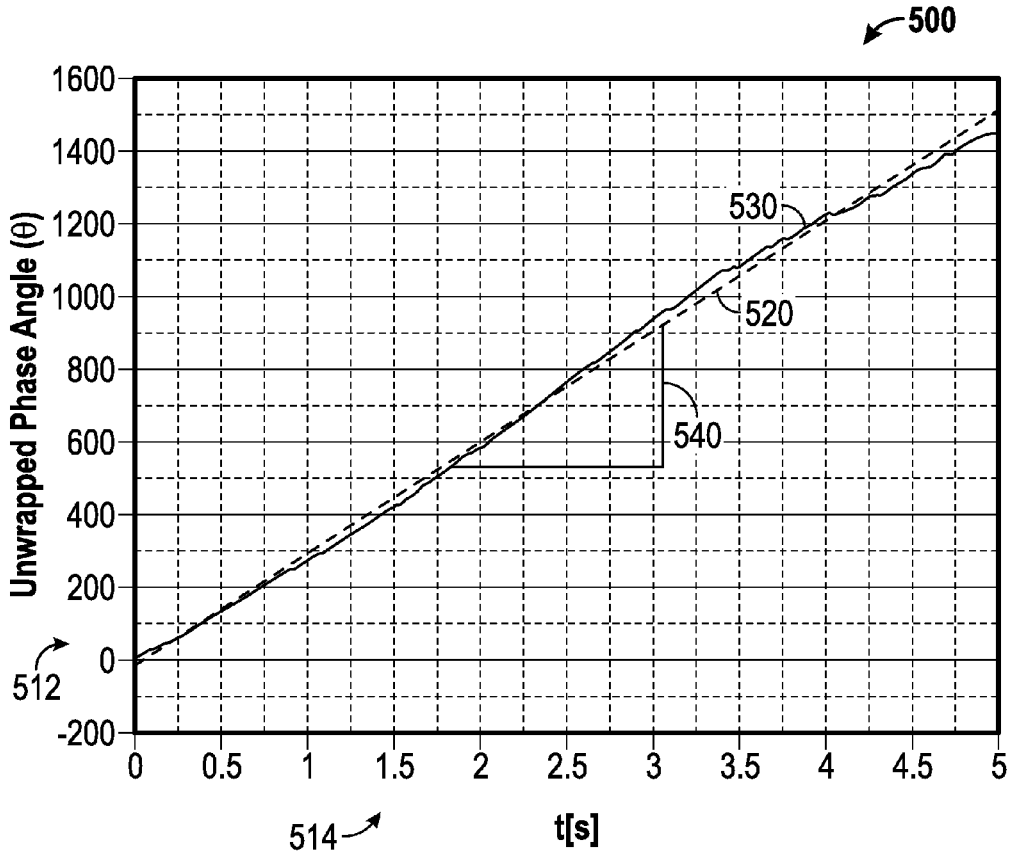
FIG. 5 is an exemplary graph showing the relationship of the phase angle and time that may be used for calculating whirl rate of a rotating tool.

FIG. 5 shows a graph 500 illustrating an exemplary method of obtaining time domain whirl rate from acceleration $a_x(t)$ and $a_y(t)$ for a known rotational speed of a tool. The phase angle (theta) may be calculated as: theta=arctan $(a_y(t)/a_x(t))$. In FIG. 5, the phase angle is plotted along the vertical axis 512 and the time t[s] along the horizontal axis 514. Line 520 is the fit line over the phase angle data 530. Slope 540 of the phase angle and the rotational speed of the tool are related as: slope=rotational speed−whirl rate. Therefore the whirl rate may be computed as: whirl rate=slope−rotational speed.

Since the rotational speed of the tool at any given time is known and the slope 540 can be computed from the $a_x(t)$ and $a_y(t)$ as described above, the whirl rate in time domain may be computed at any time during drilling of a wellbore.

Figure 3A:
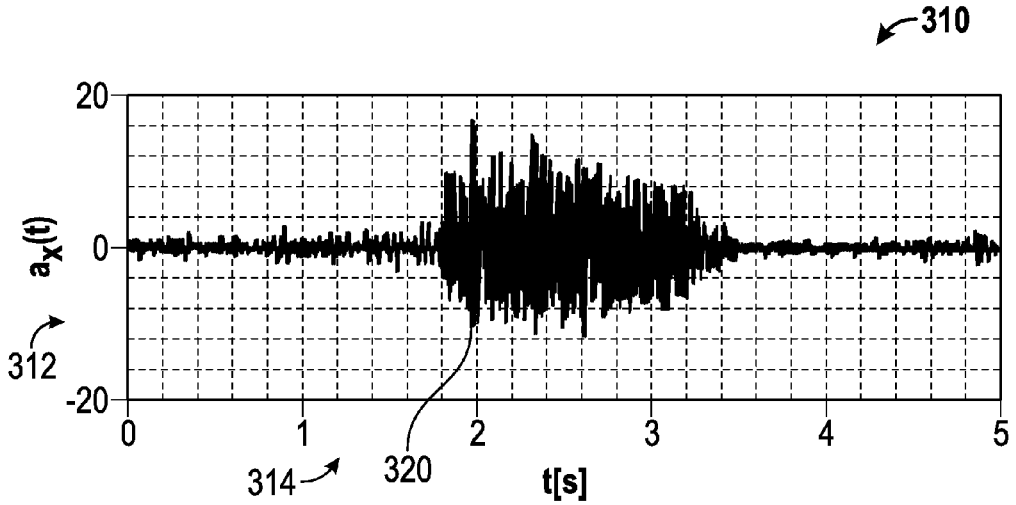
FIG. 3A is a graph showing acceleration $a_x(t)$ along the y-axis versus time t[s] along the x-axis of a rotating tool over a measurement window.
Figure 3B:
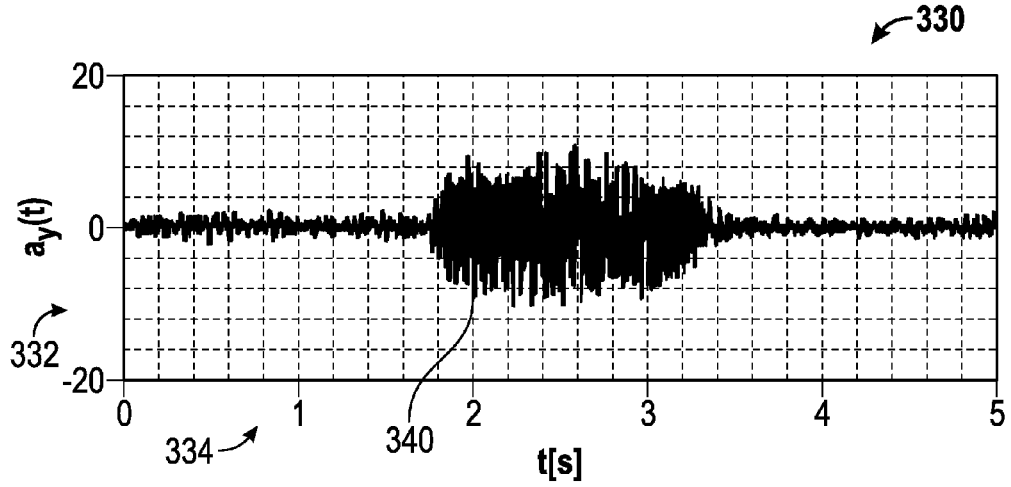
FIG. 3B is a graph showing acceleration $a_y(t)$ along the y-axis versus time t[s] along the x-axis of a rotating tool over a measurement window.
Figure 3C:
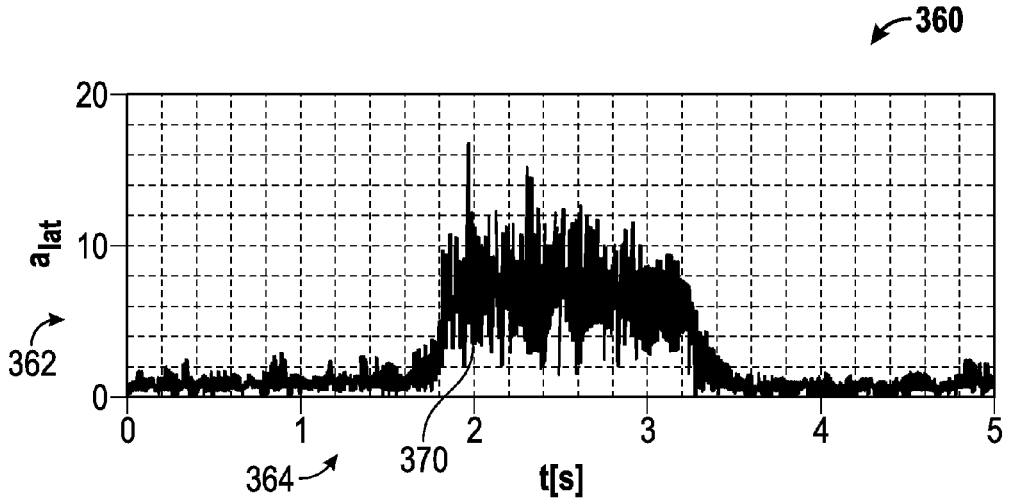
FIG. 3C shows a graph of lateral acceleration obtained from the acceleration $a_x(t)$ shown in FIG. 3A and acceleration $a_y(t)$ shown in FIG. 3B.

Once it is determined that the lateral acceleration exceeds the threshold (Box 228, the method 200 determines the $a_x(t)$ and $a_y(t)$ accelerations in the frequency domain. FIG. 3A is a graph 310 showing exemplary acceleration $a_x(t)$ measurements 320 in the time domain, wherein the vertical axis 312 represents the magnitude of the acceleration and the horizontal axis 314 represents time over which the acceleration measurements are made. In the example of FIG. 3A, the time window is five (5) seconds and the predominant acceleration occurs in the two to three second window. FIG. 3B is a graph 330 showing an exemplary acceleration $a_y(t)$ measurements 340 in the time domain, wherein the vertical axis 332 represents the magnitude of the tangential acceleration and the horizontal axis 334 represents time over which the measurements are made. The time window for the measurements 340 is five (5) seconds and the predominant tangential acceleration occurs in the window between two and three seconds. The magnitude of the accelerations 312 and 332 may be dimensional, have units, such as "g" or "$g^2$" or it may be dimensionless, such as decibels. FIG. 3C shows a graph 360 of lateral acceleration 370 computed from the acceleration $a_x(t)$ shown in FIG. 3A and acceleration $a_y(t)$ shown in FIG. 3B. In one aspect, the lateral acceleration 370 may be the vector sum of $a_x(t)$ and $a_y(t)$. The magnitude of the lateral acceleration 370 in the time domain $a_{lat}(t)$ 360 is shown along the vertical axis 362 and the time is shown along the horizontal axis 364. The lateral acceleration is shown in a selected window of one second.

Figure 4A:
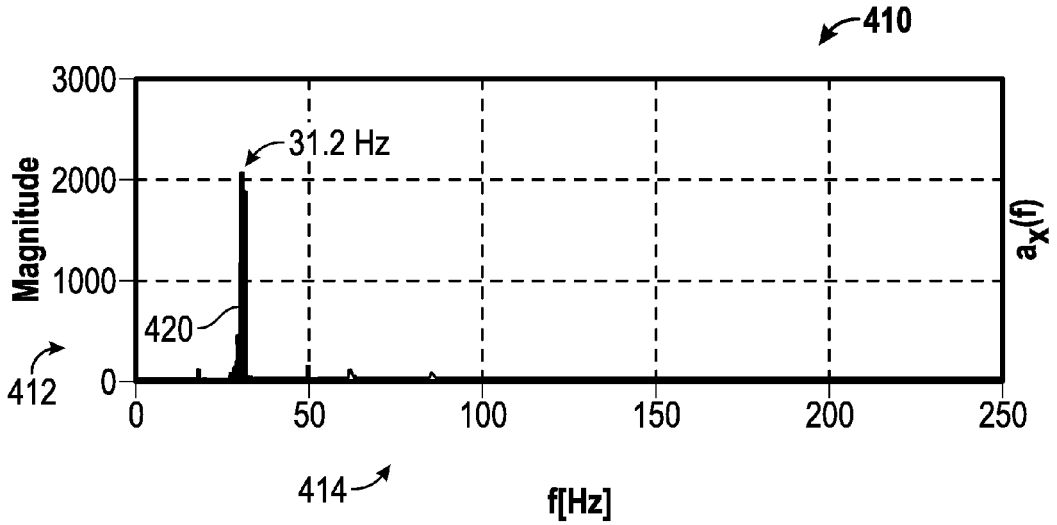
FIG. 4A is a graph showing the magnitude of acceleration $a_x(f)$ of the tool in the frequency domain along the y-axis and the frequency f[Hz] along the x-axis.
Figure 4B:
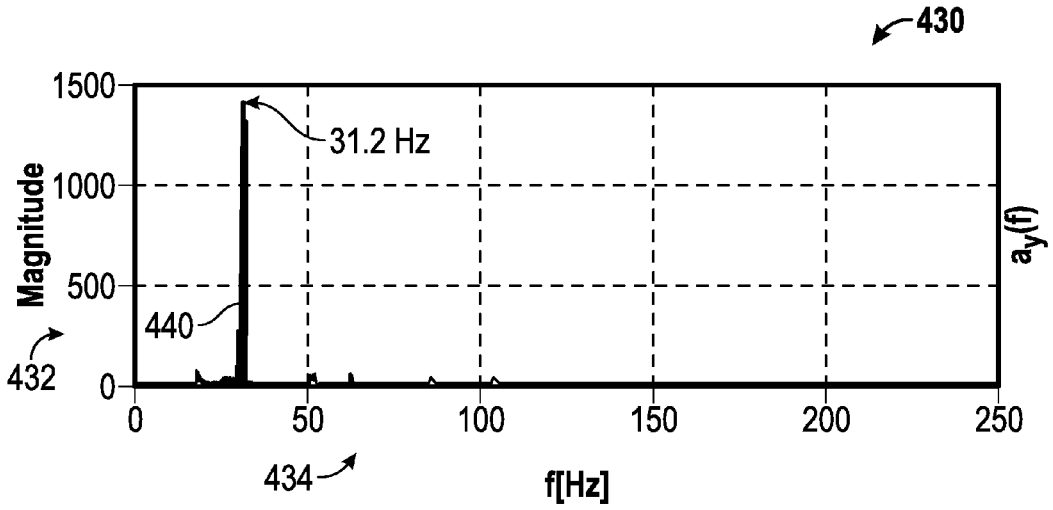
FIG. 4B is a graph showing magnitude of acceleration $a_y(f)$ of the tool in the frequency domain along the y-axis and the frequency f[Hz] along the x-axis.

FIG. 4A is a graph 410 showing the acceleration $a_x(f)$ of the tool in the frequency domain, which may be obtained using any suitable technique, including Fast Fourier Transform. FIG. 4A shows the magnitude of the acceleration $a_x(f)$ along the vertical axis 412 and the frequency f[Hz] along the horizontal axis 414. FIG. 4A shows that the dominant frequency component or peak acceleration 420 occurs at a frequency of about 31.2 Hz. FIG. 4B is a graph 430 showing acceleration $a_y(f)$ of the tool in the frequency domain, which may be obtained using any suitable technique, including Fast Fourier transform. FIG. 4B shows the magnitude of the acceleration $a_y(f)$ along the vertical axis 432 and the frequency f[Hz] along the horizontal axis 434. FIG. 4B shows that the dominant frequency component or peak acceleration 440 occurs at a frequency of about 31.2 Hz. Although the particular examples of FIGS. 4A and 4B show one peak for the acceleration, in various cases, there may be two or more peaks.

Referring back to FIG. 2, computing the accelerations $a_x(f)$ and $a_y(f)$ in the frequency domain are respectively shown in boxes 252*a* and 252*b*. From $a_x(f)$ and $a_y(f)$, the dominant frequency for each is determined (Box 252) as described in reference to FIGS. 4A and 4B. If there is no dominant frequency (Box 255), the process stops (Box 257), concluding absence of whirl. The method then determines whether the difference between dominant frequencies of $a_x(f)$ and $a_y(f)$ is within a tolerance (Box 254). If no, the process stops (Box 256), concluding absence of whirl. If yes (Box 258), the method computes the whirl rate in the frequency domain (Box 260). The method then compares magnitudes of the computed time domain whirl and the frequency domain whirl (Box 270) and if they are outside a tolerance (Box 272), the process stops (Box 274), confirming or concluding absence of whirl. If yes (Box 276), the method concludes the presence of whirl and quantifies the whirl rate (Box 280). Thus, the method determines when or whether the whirl is present from the measurements of a parameter relating to whirl (acceleration, for example) relating to whirl in at least two directions and quantifies the whirl rate.

Thus, in general, the method in one embodiment determines whether the lateral acceleration is elevated, and if so, whether the accelerations in two orthogonal or substantially orthogonal directions in the frequency domain have relatively focused peaks and, if so, then whether the calculated whirls in the time domain and the frequency domain match or are consistent with each other. Such a method provides a verified existence of whirl and its magnitude. This is because the lateral accelerations $a_{lat}$ during well-developed backward whirl events are high due to higher frequency of vibrations and significant impacts. The backward whirl rate can be reliably calculated. The lateral acceleration in general depends upon several factors, such as formation type, drilling assembly configuration wellbore inclination, drilling parameters, etc. Therefore, the threshold for the lateral acceleration may be chosen based on the drilling assembly configuration and the formation through which the drilling is performed. The above method may be implemented using the downhole control unit 190 (FIG. 1) and/or the surface control unit 140 (FIG. 1) using programmed instructions 176 (FIG. 1) for in-situ determination of the whirl rate.

As noted above, in some cases, the accelerations may exhibit two or more dominant frequencies (i.e., peaks). For example, one peak may occur at a lower frequency, for example 3 Hz, and another at a higher frequency, such as 40 Hz. If the criteria described above are met, the method analyzes the two or more peaks in the manner described above and determines the number of whirl events present and their corresponding frequencies and magnitudes.

In general, the disclosure describes an improved method and algorithm for detection of backward whirl of the drill bit and/or the drilling assembly from downhole measurements of acceleration and/or bending moments. In one aspect, a method according to a particular embodiment involves the use of three different measures: (1) acceleration magnitudes, (2) dominant frequencies in the spectral data, and (3) a whirl rate calculated from the accelerations. Specifically, when the acceleration magnitude exceeds a threshold value, and the spectral and calculated frequencies match or substantially match each other, and the calculated frequency indicates backward precession, whirl is indicated. If one of these three measures is not satisfied, then backward whirl is not indicated. In aspects, this method can provide relatively accurate estimates of the whirl rate.

In other aspects, when utilizing measured lateral accelerations, the method assesses several specified criteria for detecting backward whirl. In one embodiment: (1) A threshold value of the severity of lateral accelerations is defined. The threshold may be indicated by a root mean square value or other measures of severity. The threshold may depend on several factors, including, but not limited to, the configuration and the size of the drilling assembly, formation being or to be drilled, previous data from the offsets wells etc.; (2) A time window of size smaller than the measurement window, at least encompassing events of high lateral accelerations, if any, is identified within the measured signal. If the severity of lateral vibration in the chosen window (for example computed as the root mean square value) is greater than a predefined threshold value, the calculation proceeds to step 3; (3) The whirl rate is calculated for the chosen time window using any of the existing techniques, such as phase-unwrapping method; (4) A dominant frequency is identified in the frequency spectrum for each of the orthogonal components of lateral accelerations (denoted by $a_x$ and $a_y$). The dominant frequencies may be identified by creating bins of suitable frequency range and calculating magnitude of signal within each bin; (5) The identified dominant frequencies in the $a_x(f)$ and $a_y(f)$ are compared with each other; (6) If they agree within a tolerance, an average value of the identified dominant frequencies is corroborated with the calculated whirl rate and the measured average rotational speed of the drill bit or the drill string, as the case may be; (7) if a selected relationship between the three variables is satisfied (i.e. is within a tolerance level), then backward whirl is deemed present and the calculated whirl rate is reported as the backward whirl rate; and (8) if any of the criteria mentioned above is not satisfied, then the measurement data do not indicate the presence of backward whirl.

In another aspect, the lateral accelerations may be subjected to filtering to remove effects of events that are unrelated to whirl but that may deteriorate the accuracy of the calculations of whirl rate. A process similar to the steps described above for lateral accelerations may then be followed for determining the presence of backward whirl, its magnitude and frequency. A computer program to implement the methods described herein may be utilized in a downhole device, such as processor 172 (FIG. 1), using the measurements from the sensors, such as sensors 188*a*, 188*b* and 188*a*' and 188*b*' (FIG. 1). Alternatively, the methods described herein may be implemented during post-processing of the measurements from downhole sensors. Such programs may also be utilized with computed data that may be generated by an analytical scheme, a numerical scheme or a combination thereof. Such methods may also be used as a simulation tool for design and decision making (pre-well analysis) or after the fact (post-well analysis) to characterize the behavior and performance of a well.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. A method of drilling a wellbore, comprising:

obtaining measurements of an acceleration ($a_x(t)$) relating to a whirl of a rotating tool in the wellbore along a first axis and measurements of an acceleration ($a_y(t)$) along a second axis;

determining a first whirl rate using calculations in a time domain for the rotating tool using the $a_x(t)$ and $a_y(t)$ measurements;

determining $a_x(f)$ and $a_y(f)$ in a frequency domain from a Fourier transform of $a_x(t)$ and $a_y(t)$, respectively;

confirming a presence of whirl when $a_x(f)$ has a dominant frequency and $a_y(f)$ has a dominant frequency and when a difference between the dominant frequency of $a_x(f)$ and the dominant frequency of $a_y(f)$ is within a tolerance; and using the confirmation of the presence of whirl to control the whirl of the rotating tool.

2. The method of claim 1 further comprising:

(i) determining a severity of a characteristic of the rotating tool from a root mean square value of the $a_x(t)$ and $a_y(t)$ measurements; and (ii) determining the first whirl rate when the severity of the characteristic meets a selected threshold.

3. The method of claim 2, wherein the characteristic is one of: (i) lateral acceleration; and (ii) bending moment.

4. The method of claim 1 further comprising:

(i) determining the dominant frequency for each of the $a_x(f)$ and $a_y(f)$ measurements; and (ii) determining when a difference between the dominant frequencies for $a_x(f)$ and $a_y(f)$ is within a selected tolerance.

5. The method of claim 4 further comprising:

determining presence of at least one additional dominant frequency for each of the $a_x(f)$ and $a_y(f)$ measurements; and determining a third whirl rate when the at least one additional dominant frequency for each of the $a_x(f)$ and $a_y(f)$ measurements are within the selected tolerance.

6. The method of claim 1 further comprising quantifying the whirl of the rotating tool as the first whirl rate.

7. The method of claim 1 further comprising measuring a parameter selected from the group consisting of: (i) bending moment; (ii) velocity; (iii) displacement; and (iv) a combination of acceleration, bending moment, velocity, and displacement.

8. The method of claim 1, wherein the first whirl rate is determined using a phase-unwrapping technique.

9. The method of claim 1 further comprising normalizing the dominant frequency of one of the $a_x(f)$ and $a_y(f)$ measurements by a rotational speed of the rotating tool.

10. The method of claim 1, wherein the first axis and the second axis are orthogonal to each other.

11. An apparatus for drilling a wellbore, comprising:

sensors configured to provide measurements of an acceleration ($a_x(t)$) relating to the whirl of the rotating tool along a first axis of the rotating tool and measurements of an acceleration ($a_y(t)$) along a second axis of the rotating tool:

a processor configured to:

determine a first whirl rate for the rotating tool using calculations in a time domain using the $a_x(t)$ and $a_y(t)$ measurements;

determine $a_x(f)$ and $a_y(f)$ in a frequency domain from a Fourier transform of $a_x(t)$ and $a_y(t)$, respectively;

confirm a presence of whirl when $a_x(f)$ has a dominant frequency and $a_y(f)$ has a dominant frequency and when a difference between the dominant frequency of $a_x(f)$ and the dominant frequency of $a_y(f)$ is within a tolerance; and using the confirmation of the presence of whirl to control the whirl of the rotating tool.

12. The apparatus of claim 11, wherein the processor is further configured to:

(i) determine a severity of a characteristic of the rotating tool from a root mean square value of the $a_x(t)$ and $a_y(t)$ measurements; and (ii) determine the first whirl rate when the severity of the characteristic is greater than a selected threshold.

13. The apparatus of claim 12, wherein the characteristic of the rotating tool is one of: (i) lateral acceleration of the rotating tool; and (ii) bending moments in two orthogonal directions.

14. The apparatus of claim 11 further comprising measuring a parameter selected from the group consisting of: (i) bending moment; (ii) velocity; (iii) displacement; and (iv) a combination of acceleration, bending moment, velocity and displacement.

15. The apparatus of claim 11, wherein the processor is further configured to:

(i) determine a dominant frequency for each of the $a_x(f)$ and $a_y(f)$ measurements; and (ii) determine when a difference between the dominant frequencies for $a_x(f)$ and $a_y(f)$ measurements is within a selected tolerance.

16. The apparatus of claim 11, wherein the rotating tool is a drilling tool and the $a_x(t)$ and $a_y(t)$ measurements are taken when the drilling tool is rotating.

17. The apparatus of claim 11, wherein the processor is further configured to normalize a dominant frequency of one of the $a_x(f)$ and $a_y(f)$ measurements by a rotational speed of the rotating tool.

18. A computer system, comprising:

a processor; and a non-transitory computer program accessible to the processor and having computer-executable components, wherein the processor is configured to execute components contained in the computer program to:

access measurements of an acceleration ($a_x(t)$) relating to whirl of a rotating tool along a first axis and measurements of an acceleration ($a_y(t)$) along a second axis;

determine a first whirl rate for the rotating tool using calculations in a time domain for the rotating tool using the $a_x(t)$ and $a_y(t)$ measurements;

determine $a_x(f)$ and $a_y(f)$ in a frequency domain from a Fourier transform of $a_x(t)$ and $a_y(t)$, respectively;

confirm a presence of whirl when $a_x(f)$ has a dominant frequency and $a_y(f)$ has a dominant frequency and when a difference between the dominant frequency of $a_x(f)$ and the dominant frequency of $a_y(f)$ is within a tolerance; and use the confirmation of the presence of whirl to control the whirl of the rotating tool.

19. The system of claim 18 further comprising measuring a parameter selected from the group consisting of: (i) bending moment; (ii) velocity; (iii) displacement; and (iv) a combination of acceleration, bending moment, velocity and displacement.

20. The system of claim 18, wherein the processor is further configured to:

(i) determine a severity of a characteristic of the rotating tool from a root mean square value of the $a_x(t)$ and $a_y(t)$ measurements; and (ii) determine the first whirl rate when the severity of the characteristic is greater than a selected threshold.

21. The system of claim 18, wherein the processor is further configured to:

(i) determine a dominant frequency for each of $a_x(f)$ and $a_y(f)$ measurements; and (ii) determining when a difference between the dominant frequencies for $a_x(f)$ and $a_y(f)$ measurements are within a selected tolerance.

* * * * *